US009249537B2

(12) United States Patent
Nadtoka

(10) Patent No.: US 9,249,537 B2
(45) Date of Patent: Feb. 2, 2016

(54) COMBINATION WASHER/DRYER WITH FLOW DRUM

(76) Inventor: Sergey Nadtoka, Shelby Township, MI (US)

( * ) Notice: Subject to any disclaimer, the term of this patent is extended or adjusted under 35 U.S.C. 154(b) by 709 days.

(21) Appl. No.: 13/567,873

(22) Filed: Aug. 6, 2012

(65) Prior Publication Data

US 2013/0104605 A1 May 2, 2013

Related U.S. Application Data

(60) Provisional application No. 61/553,169, filed on Oct. 29, 2011.

(51) Int. Cl.

| | |
|---|---|
| ***D06F 58/02*** | (2006.01) |
| ***D06F 58/04*** | (2006.01) |
| ***D06F 25/00*** | (2006.01) |
| ***D06F 37/06*** | (2006.01) |

(52) U.S. Cl.

CPC ..... *D06F 58/04* (2013.01); *D06F 25/00* (2013.01); *D06F 37/065* (2013.01)

(58) Field of Classification Search

CPC ..... D06F 58/02

See application file for complete search history.

(56) References Cited

U.S. PATENT DOCUMENTS 5,058,401 A * 10/1991 Nakamura et al. ..... 68/19.2

* cited by examiner

*Primary Examiner* — Jason Ko

(57) ABSTRACT

The combination washer/dryer with flow drum is an apparatus that directs the movement of fluids through the drum to improve the laundering of clothing. The apparatus comprises a tub, a drum, an air barrier, an actuator, a hot air duct, and an exhaust duct. The tub comprises a drain, a spout, and an inner space. The air barrier comprises a drum mount and a flow opening. The drum comprises a lateral wall, a first side, and a second side, each of which comprise a plurality of fluid directing blades and fluid openings. Additionally, the drum comprises a cavity. The configuration of these components and sub-components allows the apparatus to use the rotation of the fluid directing blades to direct the flow of fluids through the cavity of the drum during the washing cycle and drying cycle to providing more efficient laundering of the articles of clothing present within the drum.

6 Claims, 6 Drawing Sheets

COMBINATION WASHER/DRYER WITH FLOW DRUM

The current application claims a priority to the U.S. Provisional Patent application Ser. No. 61/553,169 filed on Oct. 29, 2011.

FIELD OF THE INVENTION

The present invention relates generally to a drum-type washing and drying machine; more particularly, a combination washing and drying machine with a flow drum that directs the flow of fluids in a manner that efficiently washes and dries the articles of clothing deposited within.

BACKGROUND OF THE INVENTION

Conventional domestic washing and drying machines provide users with a convenient way to launder their clothing in the comfort of their home. Traditionally washing and drying machines are setup as individual units. The washing machine units are typically top opening or front opening cabinet devices that house a rotating drum. The articles of clothing are deposited into the drum to be washed. Once the articles of clothing are washed, they are transferred to the drying machine. The drying machine unit is typically a front opening cabinet that also houses a rotating drum. While the intent of each unit is different both units include similar components that can be combined to form a single unit that saves space and time.

While it is well known in the art that a washing and drying machine can be combined within the same cabinet, these combination units carry several disadvantages when compared to traditional dual cabinet assemblies. One of the disadvantages observed with the combination units relates to their smaller load capacity in comparison to traditional dual cabinet units. Traditional stand alone washer and drying machine units can generally handle larger loads, due in part to their design being optimized for a singular use. Another disadvantage that is seen with current combination washer and drying machine combination units is that they take significantly longer to dry the same size loads. This disadvantage is caused by the condensation system typically employed by current washer and drying combination units. The condensation system is employed to dry the moisture found within the drum of the combination unit. For the dryer portion of the drying machine to dry the clothing, the unit must first spend time condensing the moisture found within the drum. Still another disadvantage associated with the combination washer and drying machines is that they are considered energy inefficient when compared to traditional stand alone washer and dryer units. Traditional stand alone units have the advantage of energy efficiency due to their well known design that allows manufactures to easily integrate various proven energy saving features.

It is therefore the object of the present invention to provide a washing and drying machine that utilizes a rotating drum with a plurality of blades that can efficiently wash larger loads, takes less time drying the loads, and is more energy efficient than current combination washer and drying machines. The present invention accomplishes this by improving the flow of fluids within the drum which reduces the time required for the drum to dry, which reduces the total drying time for the articles of clothing. Furthermore, by reducing the drying time the combination unit saves energy.

Additionally, the present invention has the benefit of being scaled to meet the demand of a large load size.

DETAIL DESCRIPTIONS OF THE INVENTION

All illustrations of the drawings are for the purpose of describing selected versions of the present invention and are not intended to limit the scope of the present invention.

Figure 1:
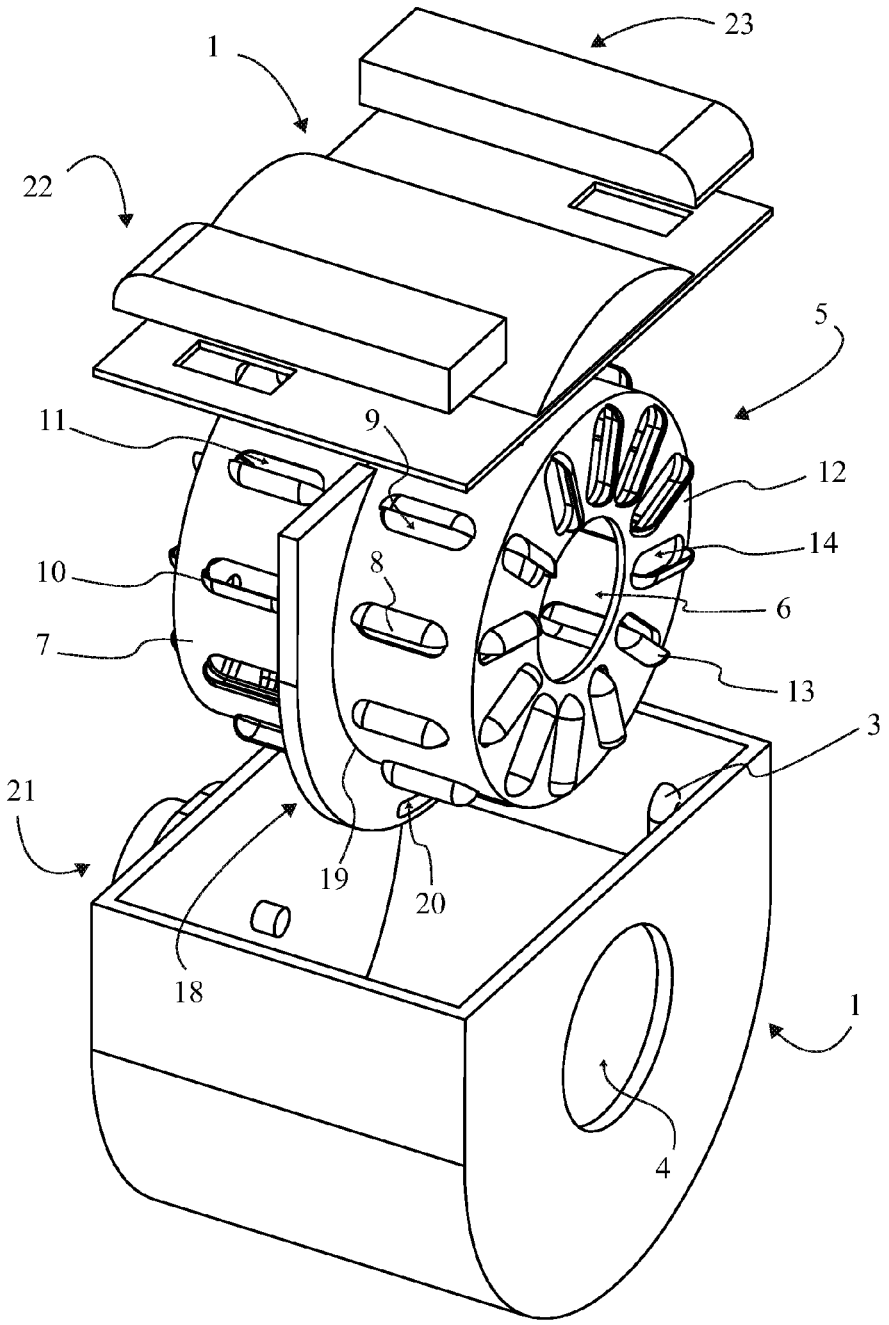
FIG. 1 is perspective view of the present invention in its preferred embodiments depicting the front portion in an expanded configuration.
Figure 2:
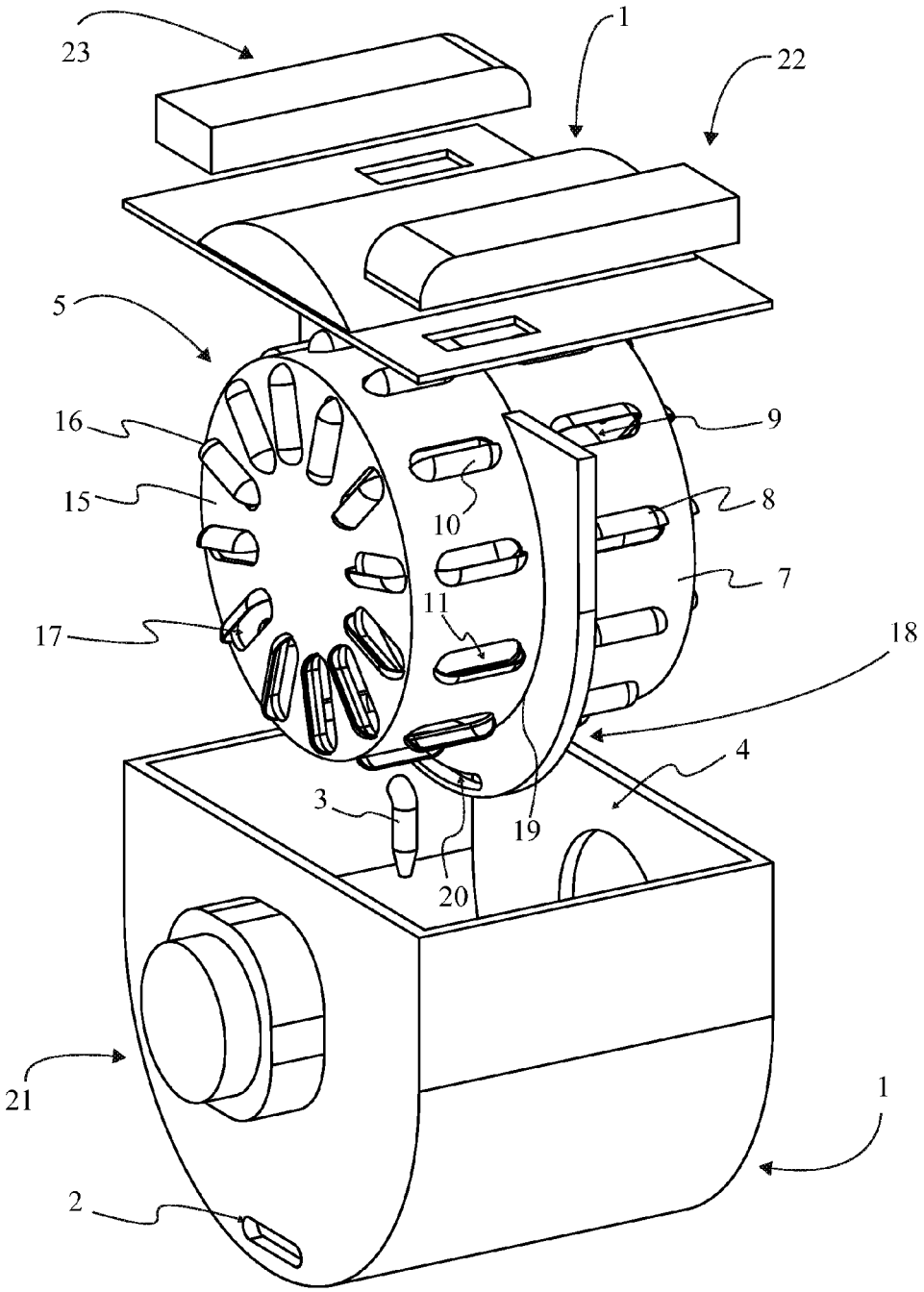
FIG. 2 is perspective view of the present invention in its preferred embodiments depicting the rear portion in an expanded configuration.

Referencing FIG. 1 and FIG. 2, the present invention is a combination washing and drying machine that circulates the flow of water over articles of clothing during the washing cycle and directs the flow of hot air over the same articles of clothing during the drying cycle. The combination washer/dryer with flow drum 5 accomplishes this through the rotation of a specialized drum 5 that provides the desired directional flow of a particular fluid dependent on the direction of its rotation. The present invention comprises a tub 1, a drum 5, an air barrier 18, a hot air duct 22, an exhaust duct 23, and an actuator 21. It should be noted that references to fluids hereafter refers to gases and liquids, unless otherwise specified. The tub 1 functions as the container that holds the fluids used to wash and dry articles of clothing in the washing cycle and drying cycle, respectively. The drum 5 functions as the rotating hollow cylinder body that holds the articles of clothing during the washing cycle and drying cycle. The air barrier 18 functions as a partition within the present invention that restricts the flow of hot air during the drying cycle. The hot air duct 22 functions as the source of hot air used to dry the articles of clothing during the drying cycle. The exhaust duct 23 functions as the exit point for the hot air used to dry the articles of clothing during the drying cycle. The actuator 21 functions as the mechanical component that provides the rotational motion that facilitates the washing and drying of the articles of clothing during the washing cycle and drying cycle, respectively.

Figure 3:
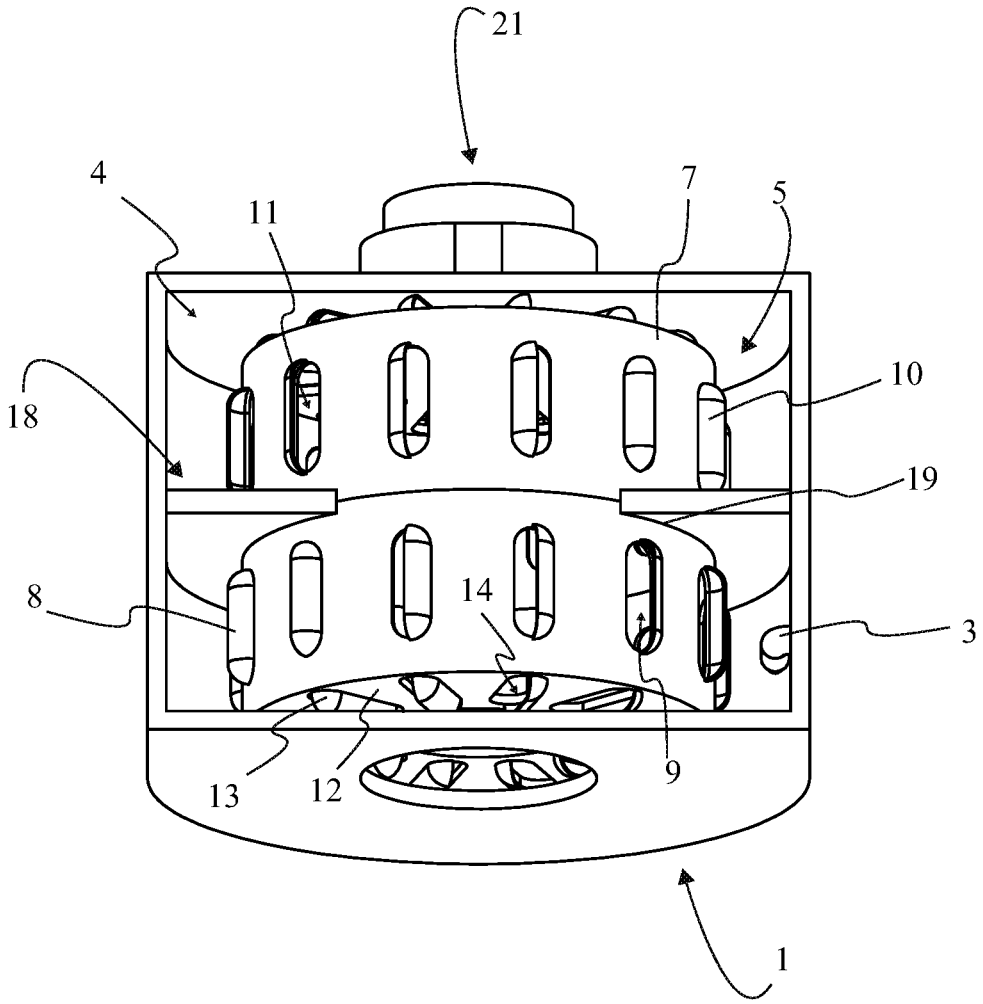
FIG. 3 is a top elevational view of the present invention in its preferred embodiment depicting the configuration of the components internalized within the tub.

Referencing FIG. 1-3, the tub 1 in the present invention serves as the container that prevents the unintended escape of fluids from the apparatus. The tub 1 houses the drum 5, the air barrier 18, and the actuator 21. Both the drum 5 and the air barrier 18 are positioned within the tub 1. In addition, the tub 1 serves as the mounting point for the hot air duct 22 and the exhaust duct 23. Both the hot air duct 22 and the exhaust duct 23 traverse into the tub 1. In the present invention, the tub 1 comprises a spout 3, a drain 2, and an inner space 4. The inner space 4 is positioned within the tub 1. The inner space 4 serves as the area of interaction between the movement of fluids during the washing and drying cycle. Both the spout 3 and the drain 2 are positioned within the inner space 4. The spout 3 serves as the source of water that is used to wash articles of clothing during the washing cycle. Conversely, the drain 2 functions as the exiting point for the water that is used to wash articles of clothing during the washing cycle.

Referencing FIG. 3-6, the air barrier 18 in the present invention serves as the partition that restricts the flow of air within the tub 1. The air barrier 18 is positioned within the tub 1. The air barrier 18 is traversed by the drum 5. The air barrier 18 comprises a drum mount 19 and a flow opening 20. Both the drum mount 19 and the flow opening 20 are positioned on the air barrier 18 and subsequently, are positioned adjacent to each other. The hot air duct 22 in the present invention serves as the source of hot air that is used to dry the articles of clothing during the drying cycle. The hot air duct 22 is mounted to the external surface of the tub 1, but a portion of the hot air duct 22 traverses into the tub 1. The portion of the hot air duct 22 that traverses into the tub 1 is positioned tangent to the drum 5. The exhaust duct 23 in the present invention serves as the exiting point for the hot air provided by the hot air duct 22 during the drying cycle. The exhaust duct 23 is mounted to the external surface of the tub 1, but a portion of the exhaust duct 23 traverses into the tub 1. The portion of the exhaust duct 23 that traverses into the tub 1 is positioned tangent to the drum 5. The actuator 21 in the present invention serves as the driving mechanism that provides the bidirectional rotation to the drum 5 for use in the washing and drying cycles. The actuator 21 is housed by the tub 1 and is rotatably connected to the drum 5.

Referencing FIG. 4-6, the drum 5 in the present invention functions as the rotating hollow cylinder body in which articles of clothing are deposited into and are subsequently laundered. The drum 5 traverses the air barrier 18. The drum 5 and the air barrier 18 are positioned within the tub 1. The drum 5 is rotatably connected to the actuator 21. The actuator 21 provides the drum 5 with bidirectional rotation about their connection point. The hot air duct 22 being positioned tangent to the drum 5. The exhaust duct 23 being positioned tangent to the drum 5. The drum 5 comprises a first side 12, a lateral wall 7, a second side 15, and a cavity 6. The lateral wall 7 is the round exterior surface of the cylinder body. The first side 12 and the second side 15 are the flat exterior surfaces of the cylinder body. Resultantly, the lateral wall 7 is positioned between the first side 12 and the second side 15. The cavity 6 is the internalized portion of the container, wherein the articles of clothing are deposited in order to be laundered.

Referencing FIG. 3, the lateral wall 7 comprises a plurality of first lateral blades 8, a plurality of first lateral fluid openings 9, a plurality of second lateral blades 10, and a plurality of second lateral fluid openings 11. The plurality of first lateral blades 8 is positioned perimetrically around the lateral wall 7. Each of the plurality of lateral first blades 8 is oriented in the same direction, wherein the plurality of first lateral blades 8 is oriented in a clockwise or counter clockwise direction relative to rotation of the drum 5. Each of the plurality of first lateral fluid openings 9 traverses through the lateral wall 7 and into the cavity 6. The plurality of first lateral fluid openings 9 is coincident with the plurality of first lateral blades 8. The plurality of second lateral blades 10 is positioned perimetrically around the lateral wall 7. Each of the plurality of second lateral blades 10 is oriented in the same direction, wherein the plurality of second lateral blades 10 are oriented in a clockwise or counter clockwise direction relative to the rotation of the drum 5. While the direction of the plurality of first lateral blades 8 and the direction of the plurality of second lateral blades 10 are relative to the rotation of the drum 5, the direction of the plurality of first lateral blades 8 is always opposite that of the direction of the plurality of second lateral blades 10. Each of the plurality of second lateral fluid openings 11 traverses through the lateral wall 7 and into the cavity 6. The plurality of second lateral fluid openings 11 is coincident with the plurality of second lateral blades 10. The plurality of first lateral blades 8 is positioned adjacent to the plurality of second lateral blades 10. The first side 12 comprises a plurality of first side blades 13 and a plurality of first side fluid openings 14. The plurality of first side blades 13 are positioned radially on the first side 12. Each of the plurality of first side fluid openings 14 traverses through the first side 12 and into the cavity 6. The plurality of first side fluid openings 14 is coincident with the plurality of first side blades 13. The plurality of first side blades 13 are positioned adjacent to the plurality of first lateral blades 8. The second side 15 comprises a plurality of second side blades 16 and a plurality of second side fluid openings 17. The plurality of second side blades 16 is positioned radially on the second side 15. Each of the plurality of second side fluid openings 17 traverses through the second side 15 and into the cavity 6. The plurality of second side fluid openings 17 is coincident with each of the plurality of second side blades 16. The plurality of second side blades 16 is positioned adjacent to the plurality of second lateral blades 10. The plurality of first side blades 13 is positioned opposite to the plurality of second side blades 16 relative to the positioning of the lateral wall 7.

Figure 5:
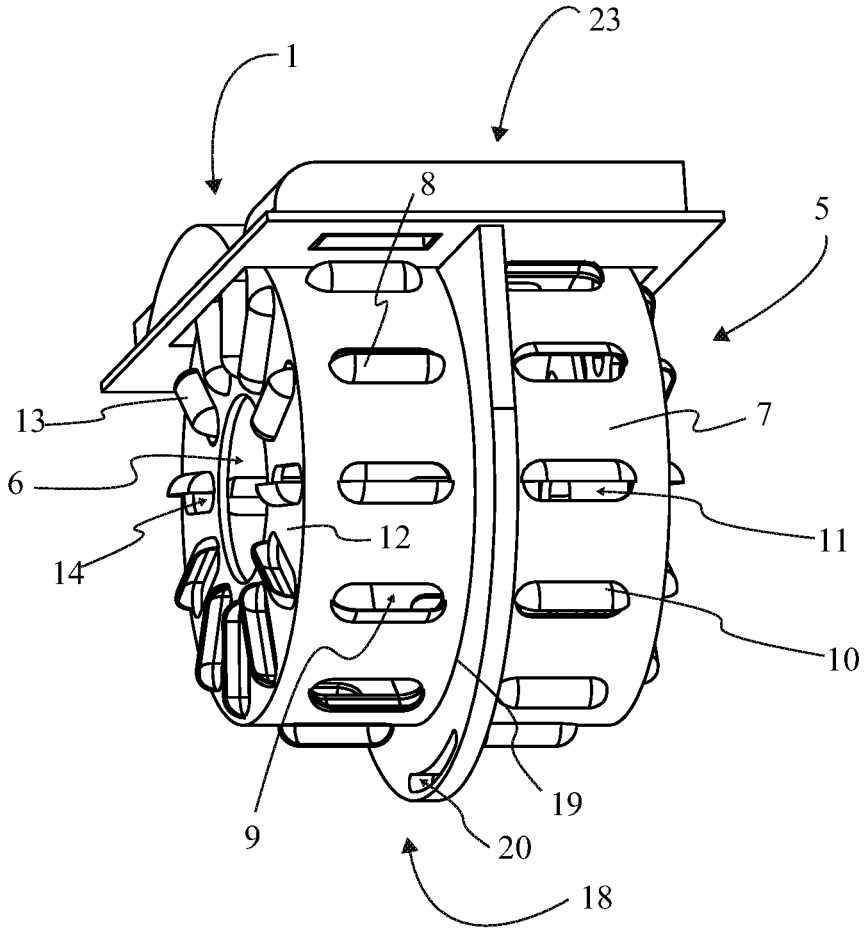
FIG. 5 is a perspective view of the present invention in its preferred embodiment depicting the relation between the exhaust duct and the plurality of first lateral blades.
Figure 6:
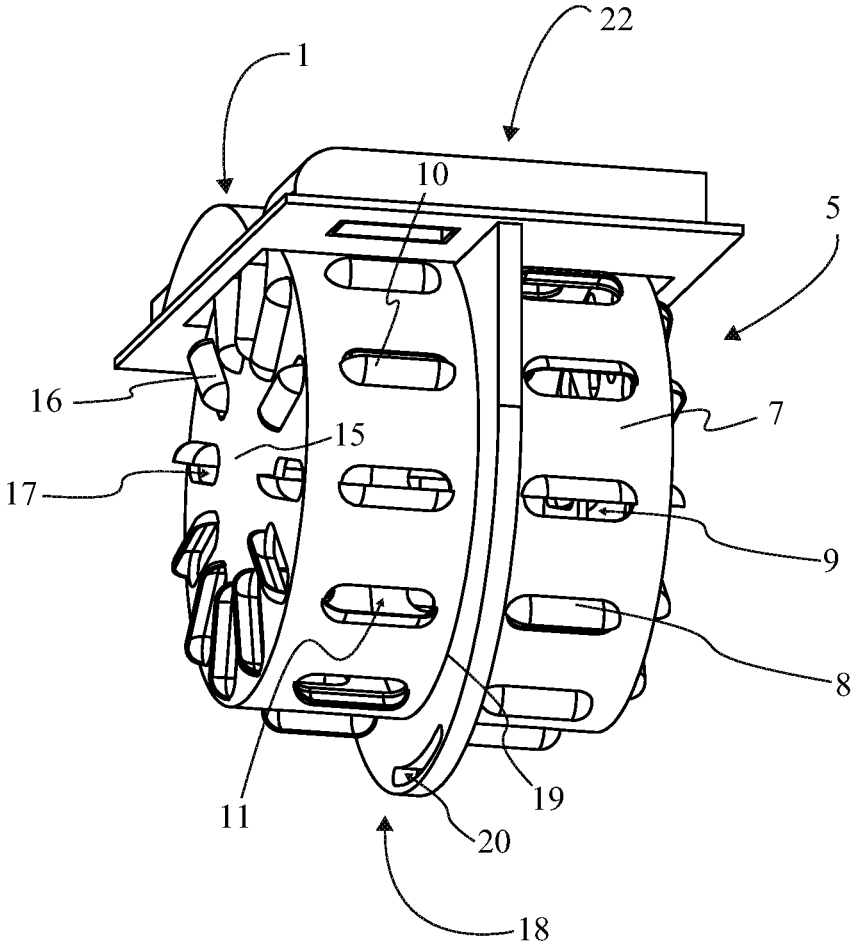
FIG. 6 is a perspective view of the present invention in its preferred embodiment depicting the relation between the hot air duct and the plurality of second lateral blades.

Referencing FIG. 5 and FIG. 6, the drum 5 is connected to the air barrier 18 by way of the drum mount 19. The drum mount 19 serves as the point of contact between the drum 5 and the air barrier 18. The drum mount 19 is positioned on the lateral wall 7 of the drum 5, but more specifically the drum mount 19 is positioned in between the plurality of first lateral blades 8 and the plurality of second lateral blades 10. The drum 5 and the air barrier 18 are positioned within the inner space 4. The positioning of the air barrier 18 and the drum 5 within the inner space 4 causes the air barrier 18 to partition the inner space 4, restricting the flow of air from one side of the partition to the other. The hot air duct 22 traverses into the inner space 4 and is positioned collinear to the plurality of second lateral fluid openings 11. The exhaust duct 23 traverses into the inner space 4 and is positioned collinear to the plurality of first lateral fluid openings 9. The actuator 21 is connected to the second side 15 of the drum 5. The actuator 21 rotates the drum 5 in either a clockwise or counter clockwise direction dependent on whether the apparatus is going through a washing cycle or a drying cycle.

Figure 4:
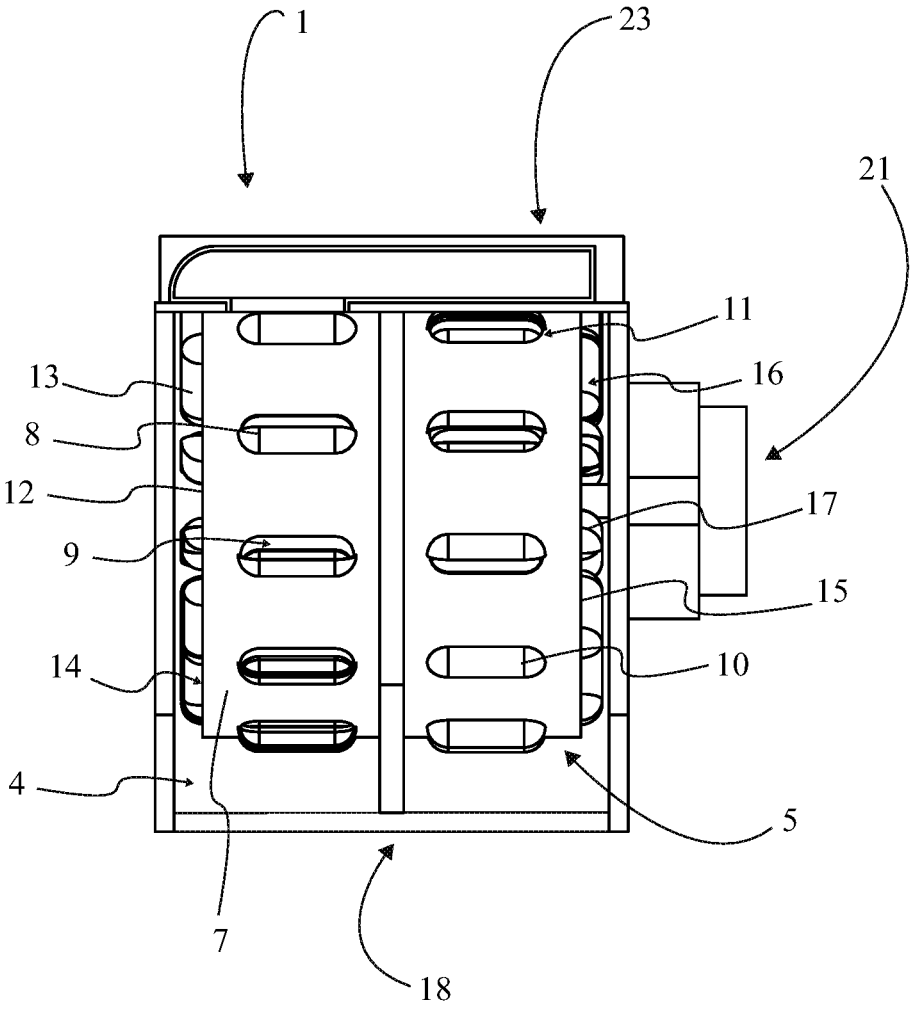
FIG. 4 is a cross sectional view of the present invention in its preferred embodiment depicting the configuration of the components internalized within in the tub.

Referencing FIG. 4-6, during instances when the drum 5 rotates, the drum mount 19 provides minimal resistance to the lateral wall 7 while restricting the movement of fluid between the partitioned areas of the inner space 4. Fluid movement is facilitated during the rotation of the drum 5 by the plurality of first lateral blades 8, the plurality of first side blades 13, the plurality of second lateral blades 10, and the plurality of second side blades 16 which are able to direct the flow of the fluid into the cavity 6 by way of the plurality of first lateral fluid openings 9, the plurality of first side fluid openings 14, the plurality of second lateral fluid openings 11, and the plurality of second side fluid openings 17, respectively.

In the preferred embodiment of the present invention the plurality of first lateral blades 8 and the plurality of first side blades 13 are positioned facing in a the counter clockwise direction, wherein during a counter clockwise rotation of the drum 5 the plurality of first lateral blades 8 and the plurality of first side blades 13 direct the flow of fluids into the cavity 6 by way of the plurality of first lateral fluid openings 9 and the plurality of first side fluid openings 14, respectively. The fluid traverses the cavity 6 and interacts with the articles of clothing present within. The fluid exits the cavity 6 through the plurality of second lateral fluid openings 11 and the plurality of second side fluid openings 17. It should be noted that references to the aggregate of the plurality of first lateral blades 8 and the plurality of first side blades 13 is hereinafter referred to as the first blades, unless otherwise specified. Additionally it should be noted that references to aggregate of the plurality of first lateral fluid openings 9 and the plurality of first side fluid openings 14 is hereinafter referred to as the first openings, unless otherwise specified.

In the preferred embodiment of the present invention the plurality of second lateral blades 10 and the plurality of second side blades 16 are positioned facing in a clockwise direction, wherein during a clockwise rotation of the drum 5 the plurality of second lateral blades 10 and the plurality of second side blades 16 direct the flow of fluids into the cavity 6 by way of the plurality of second lateral fluid openings 11 and the plurality of second side fluid openings 17, respectively. The fluid traverses the cavity 6 and interacts with the articles of clothing present within. The fluid exits the cavity 6 through the plurality of first lateral fluid openings 9 and the plurality of first side fluid openings 14. It should be noted that references to the aggregate of the plurality of second lateral blades 10 and the plurality of second side blades 16 is hereafter referred to as the second blades, unless otherwise specified. Additionally, it should be noted that references to aggregate of the plurality of second lateral fluid openings 11 and the plurality of second side fluid openings 17 is hereafter referred to as the second openings, unless otherwise specified.

During the washing cycle, rotation of the drum 5 is dependent on the specific stage or cycle in progress. Similar to the other washing cycles found in conventional washing machines, the present invention utilizes a washing cycle that comprises a wash cycle, a spin cycle, and a rinse cycle. It should be noted that while the wash cycle and the rinse cycle are classified as separate cycles of the washing cycle, but the rotation of the drum 5 and the subsequent flow of water is the same, therefore to not unnecessarily obscure focus from the present invention, the wash cycle and the rinse cycle are hereinafter referred to as the wash and rinse cycle. During the wash and rinse cycle, the drum 5 cycles through a pattern of rotation, wherein the drum 5 rotates a particular number of revolutions (5-30 revolutions) in the counter clockwise direction before reversing directions and rotating a particular number of revolutions (5-30 revolutions) in the clockwise direction. The pattern continues until the wash and rinse cycle is completed. The direction of the rotation determines the directional flow of the water through the cavity 6 and subsequently through the article of clothing. During the spin cycle, the drum 5 rotates in the counter clockwise direction. The drum 5 rotates in the clockwise direction until the rinse cycle completes. It should be noted that references to the two partitioned sections of the inner space 4, wherein one section houses the first blades and the first openings, while other section house the second blades and the second openings, are hereinafter referred to as the first chamber and the second chamber, respectively, unless otherwise specified.

During the wash and rinse cycle, the inner space 4 is filled with water. Water is provided by the spout 3, which fills the inner space 4 with enough water to submerge the articles of the clothing found within the cavity 6. Water is allowed to flow between the first chamber and the second chamber. During counter clockwise rotation of the drum 5 in the wash and rinse cycle, the first blades direct the flow of water from the first chamber into the cavity 6 by way of the first openings. The water flows through the cavity 6 in the direction of the first chamber to the second chamber. The water exits the cavity 6 through the second openings. Once the water is in the second chamber, it is allowed to flow back into the first chamber by way of the flow opening 20. Conversely, during clockwise rotation of the drum 5 in the wash and rinse cycle, the second blades direct the flow of water from the second chamber into the cavity 6 by way of the second openings. The water flows through the cavity 6 in the direction of the second chamber to the first chamber. The water exits the cavity 6 through the first openings. Once the water is in the first chamber, it is allowed to flow back into the second chamber by way of the flow opening 20.

During the spin cycle, the drum 5 rotates in the counter clockwise direction. Water present within in the inner space 4 is evacuated through the drain 2. Water is allowed to flow between the first chamber and the second chamber. During the counter clockwise rotation of the drum 5, the first blades direct the flow of air from the first chamber into the cavity 6 by way of the first openings. The air flows through the cavity 6 in the direction of the first chamber to the second chamber. The water and air exit the cavity 6 through the second openings. Air is allowed to flow back into the first chamber by way of the flow opening 20. Water is allowed to exit through the drain 2.

During the drying cycle, rotation of the drum 5 occurs in the clockwise direction. Similar to other drying cycles found in conventional drying machines, the present invention in its preferred embodiment utilizes hot air to dry articles of clothing. In the drying cycle, the hot air for drying the articles of clothing is provided by the hot air duct 22. The hot air duct 22 injects hot air into the second chamber, but due to the clockwise direction of the second blades and the collinear arrangement between the hot air duct 22 and the plurality of second lateral fluid openings 11, the majority of the hot air is immediately directed into the cavity 6. Hot air that is not immediately directed into the cavity 6 fills the second chamber, but due to the air barrier 18, the clockwise rotation of the drum 5, and the second blades and second openings, the hot air is recovered and forced into the cavity 6. The hot air traverses the cavity 6 in the direction of the second chamber to the first chamber. The hot air aerates the articles of clothing, after which the hot air exits through the first openings. Due to the counter clockwise direction of the first blades, the collinear arrangement between the plurality of first lateral fluid openings 9 and the exhaust duct 23, and the air barrier 18, the majority of the hot air is directed out of the cavity 6 into the exhaust duct 23.

In the preferred embodiment of the present invention, the actuator 21 is a motor that is capable of rotating the drum 5 in either a clockwise or counter clockwise direction. The actuator 21 used to power the rotation of the drum 5 in the present invention is similar to motors used by other devices in the art. The relative positioning of the actuator 21 is only dependent on its ability to rotate the drum 5. Furthermore, it should be noted that the actuator 21 can include a control mechanism that allows a user to set the desired settings which can include but are not limited to, time, speed, type of cycle, and any combination thereof that allows the present invention launder their articles of clothing.

In the preferred embodiment of the present invention, hot air is provided to the hot air duct 22 through the use of a heating system. The present invention utilizes a heating system that is similar to heating systems in use by conventional drying machines and combination washing and drying machines. The heating system can be located, powered, and controlled through similar methods utilized by heating systems in use by conventional drying machines and combination washing and drying machines.

In the preferred embodiment of the present invention, the removal of circulated air from the inner space 4 through the exhaust duct 23 is facilitated through the use of an exhaust fan system. The present invention utilizes an exhaust fan system that is similar to exhaust fan system in use by conventional drying machines and combination washing and drying machines. The exhaust fan system can be located, powered, and controlled through similar methods utilized by heating systems in use by conventional drying machines and combination washing and drying machines.

In the preferred embodiment of the present invention, the first openings and the second openings function as an entrance for various fluids such as water and air. In addition the first openings and the second openings are able to prevent articles of clothing and non-fluids from escaping the cavity 6 through the use of a screen. The screen can be a mesh wire or a plurality of slotted holes that traverse the lateral wall 7, the first side 12, and the second side 15 into the cavity 6.

In the preferred embodiment of the present invention, the tub 1 is described as a singular entity. Referencing FIG. 1 and FIG. 2, these figures show the tub 1 being comprised of two pieces, an upper section and a lower section. The upper section provides the mounting point for the hot air duct 22 and the exhaust duct 23. The lower section provides the mounting point for the actuator 21, air barrier 18, and the drum 5. Even though there are two sections to the tub 1, it should be understood that the functionality of the present invention does not necessitate the differentiation of the two sections. Furthermore, it should be considered an obvious difference that the tub 1 can comprise multiple pieces capable of providing the same functionality as the present embodiment of the tub 1. Additionally, the positioning of the spout 3 and the drain 2 within the inner space 4 can be placed anywhere as long as the positioning does not impair the functionality of other components. Preferably, the positioning of the drain 2 should be positioned beneath the drum 5 in either the first chamber or second chamber. Preferably the spout 3 should be positioned within the inner space 4 in a manner that does not conflict with the rotation of the drum 5. Furthermore, it should be noted that the tub 1*e* can include access for that provides the user with the ability to deposit and remove articles of clothing from within the tub 1.

The preferred embodiment of the present invention has calculated an optimal value set for the dimensions of the drum 5, the plurality of first lateral blades 8, the plurality of first lateral fluid openings 9, the plurality of second lateral blades 10, the plurality of second lateral fluid openings 11, the plurality of first side blades 13, the plurality of first side fluid openings 14, the plurality of second side blades 16, and the plurality of second side fluid openings 17, as well as the necessary rotational velocity for the drum 5 that would yield the highest rate of fluid movement within in the cavity 6. the calculations utilized existing washing and drying machines configurations to develop a minimum and maximum value ranges for the dimensions of the drum 5 and the rotational velocities commonly used by the these apparatuses. The calculations further included theoretical minimum and maximum values sets for the dimensions associated with the plurality of first lateral blades 8, the plurality of first lateral fluid openings 9, the plurality of second lateral blades 10, the plurality of second lateral fluid openings 11, the plurality of first side blades 13, the plurality of first side fluid openings 14, the plurality of second side blades 16, and the plurality of second side fluid openings 17, as well as for the values for the quality of the blades. From the value sets, an optimal combination for the dimension and velocity of the components and sub-components of the present invention were obtained.

In the preferred embodiment of the present invention, the hot air duct 22 and the exhaust duct 23 do not describe a mechanism that prevents the flow of water into the either duct. While this is the case it should be understood that the exhaust duct 23 and the hot air duct 22 can include a mechanism that closes the ducts during the washing cycle. This mechanism can be similar to solutions already implemented by other similar apparatuses in the art.

In the preferred embodiment of the present invention, the air barrier 18 is a described as a singular entity. While this is the manner in which the air barrier 18 is described it should be understood that the air barrier 18 could potentially consist of multiple pieces that accomplish the same functionality. Furthermore, the drum mount 19 of the air barrier 18, as it is described, does not demonstrate how the drum 5 is able to rotate while mounted to the drum mount 19. It should be clarified that the drum mount 19 can potentially include a system of rollers or ball bearings that allow the drum 5 to rotate within the mount as well as preventing the flow of fluids to occur within that point, in a manner that is most efficient to the functionality of the invention as a whole. Moreover, it should be clarified that the flow opening 20 of the air barrier 18 as described alludes to component consisting of a singular entity. While this is the case it should be clarified that the flow opening 20 can consist of multiple openings that traverse the air barrier 18. Additionally, it should be clarified that the flow opening 20 can include a device that prevents the flow of certain fluids in a particular direction. The device that could potentially be used would likely be a flip plate. The flip plate would allow water to flow between the first chamber and the second chamber during the washing cycle, but prevent the flow of air between both the first chamber and the second chamber during the drying cycle.

An additional embodiment of the present invention can utilizes a plurality of lateral blades that are positioned perimetrically around the lateral wall 7 but differ from the preferred embodiment in that they extend the full length of the lateral wall 7. Each of the plurality of lateral blades are positioned coincident to a plurality of fluid openings that can comprise a single opening or multiple smaller openings.

It should be noted that the present invention is intended for use in domestic applications. Yet due to its design the present invention can be scaled up or down in relative size and achieve the same results. The present invention in scaled up in size could potentially be used for commercial or industrial application and uses not generally associated with the washing of clothing. Such application can include the washing or drying of various materials used for manufacturing. These materials can include but are not limited to animal fibers, raw materials used in textiles, mechanical components, or any material that could potentially benefit from being washed or dried through mechanical means.

Although the invention has been explained in relation to its preferred embodiment, it is to be understood that many other possible modifications and variations can be made without departing from the spirit and scope of the invention as hereinafter claimed.

What is claimed is:

1. A combination washer/dryer with flow drum comprises,
a tub;
a drum;
a hot air duct;
an exhaust duct;
an air barrier;
an actuator;
the tub comprises an inner space, a spout, and a drain;

the drum comprises a lateral wall, a first side, a second side, and a cavity;

the air barrier comprises a drum mount and a flow opening;

the lateral wall comprises a plurality of first lateral blades, a plurality of first lateral fluid openings, a plurality of second lateral blades, and a plurality of second lateral fluid openings;

the first side comprises a plurality of first side blades and a plurality of first side fluid openings;

the second side comprises a plurality of second side blades and a plurality of second side fluid openings; and the plurality of first lateral fluid openings being coincident with the plurality of first lateral blades;

the plurality of second lateral fluid openings being coincident with the plurality of second lateral blades;

the plurality of first side fluid openings being coincident with the plurality of first side blades; and the plurality of second side fluid openings being coincident with each plurality of second side blades.

2. The combination washer/dryer with flow drum as claimed in claim 1 comprises, both the hot air duct and the exhaust duct traverse into the tub;

the air barrier being traversed by the drum;

both the drum and the air barrier being positioned within the tub, wherein the tub and the air barrier are static during the rotation of the drum;

the hot air duct being positioned tangent to the drum;

the exhaust duct being positioned tangent to the drum;

the actuator being housed by the tub; and the drum being rotatably connected to the actuator.

3. The combination washer/dryer with flow drum as claimed in claim 1 comprises, the flow opening being positioned adjacent to the drum mount;

the inner space being housed within the tub;

the cavity being surrounded by the lateral wall, the first side, and the second side;

the lateral wall being positioned between the first side and the second side; and both the spout and the drain being positioned within the inner space.

4. The combination washer/dryer with flow drum as claimed in claim 1 comprises, the plurality of first lateral blades being positioned perimetrically around the lateral wall;

the plurality of second lateral blades being positioned perimetrically around the lateral wall;

the plurality of first side blades being positioned radially on the first side;

the plurality of second side blades being positioned radially on the second side;

each of the plurality of first lateral fluid openings traverse through the lateral wall and into the cavity;

each of the plurality of second lateral fluid openings traverse through the lateral wall and into the cavity;

each of the plurality of first side fluid openings traverse through the first side and into the cavity; and each of the plurality of second side fluid openings traverse through the second side and into the cavity.

5. The combination washer/dryer with flow drum as claimed in claim 1 comprises, the plurality of first side blades being positioned adjacent to the plurality of first lateral blades;

the plurality of first lateral blades being positioned adjacent to the plurality of second lateral blades;

the plurality of second lateral blades being positioned adjacent to the plurality of second side blades; and the plurality of second side blades being positioned opposite to the plurality of first side blades.

6. The combination washer/dryer with flow drum as claimed in claim 1 comprises, both the exhaust duct and the hot air duct traverse into the inner space;

the drum and the air barrier being housed within the inner space;

the second side being connected to the actuator;

the drum mount being positioned between the plurality of first lateral blades and the plurality of second lateral blades;

the inner space being partitioned by the air barrier;

the exhaust duct being positioned adjacent to the plurality of first lateral fluid openings, wherein each of the plurality of first fluid openings align with the exhaust duct during the rotation of the drum; and the hot air duct being positioned adjacent to the plurality of second lateral fluid openings, wherein each of the plurality of second fluid openings align with the hot air duct during the rotation of the drum.

* * * * *